US005835118A

United States Patent [19]

Fisher, Sr. et al.

[11] Patent Number: 5,835,118

[45] Date of Patent: Nov. 10, 1998

[54] DYE CARTRIDGE SYSTEM AND METHOD ADAPTED TO TENSION A DYE RIBBON ASSOCIATED THEREWITH

[75] Inventors: Terrence L. Fisher, Sr., Rochester; Robert F. Mindler, Churchville, both of N.Y.

[73] Assignee: Eastman Kodak Company, Rochester, N.Y.

[21] Appl. No.: 947,684

[22] Filed: Oct. 9, 1997

[51] Int. Cl.[6] ..... B41J 32/00; B41J 35/08

[52] U.S. Cl. ..... 347/214; 400/254; 400/208; 400/208.1

[58] Field of Search ..... 347/214; 400/207, 400/208, 208.1, 234, 247, 248; 242/170, 172

[56] References Cited

U.S. PATENT DOCUMENTS

| | | | |
|---|---|---|---|
| 4,978,240 | 12/1990 | Katsuno | 347/234 |
| 5,246,299 | 9/1993 | Kitsuki et al. | 347/234 |
| 5,661,515 | 8/1997 | Hevenor et al. | 347/215 |

*Primary Examiner*—Huan H. Tran
*Attorney, Agent, or Firm*—Walter S. Stevens

[57] ABSTRACT

A cartridge system and method adapted to tension a dye ribbon associated therewith. The cartridge system is disposed in a printer that includes an enclosure. A first spool belonging to the cartridge system is disposed in the enclosure. The first spool has the dye ribbon wound thereabout. The dye ribbon has a leading end portion extending from the first spool. A second spool is associated with the first spool, the second spool having the leading end portion of the dye ribbon connected thereto. A cartridge body, which houses the first spool and the second spool, has a flexible portion movable from a first position thereof spaced-apart from the dye ribbon wound about the first spool to a second position thereof into engagement with the dye ribbon wound about the first spool. When the flexible portion moves to the second position thereof, it imposes a drag force acting on the dye ribbon in order to tension the dye ribbon as the drag force acts on the dye ribbon. Moreover, a biasing member engages the flexible portion of the cartridge body for biasing the flexible portion, so that the flexible portion moves from the first position thereof to the second position thereof as the flexible portion is biased.

12 Claims, 8 Drawing Sheets

DYE CARTRIDGE SYSTEM AND METHOD ADAPTED TO TENSION A DYE RIBBON ASSOCIATED THEREWITH

FIELD OF THE INVENTION

This invention generally relates to dye cartridge apparatus and methods and more particularly relates to a dye cartridge system and method adapted to tension a dye ribbon associated therewith.

A typical thermal resistive printer has an enclosure for enclosing the components of the printer. Receiver medium is fed from a supply tray to a print head housed in the enclosure. The receiver medium fed to the print head is brought into contact with a dye donor web carried by a dye donor cassette disposed near the print head. The resistive elements in print head heat activates the dye donor web to transfer the dye to the receiver medium in order to print an output image on the receiver medium.

The dye donor cassette includes two parallel spaced-apart side arms having ends thereof respectively connected to a pair of end shells. The spaced-apart side arms define an opening therebetween. A supply spool is disposed in a first one of the shells and a take-up spool is disposed in a second one of the shells. One end of the dye donor web is mounted on the supply spool within the first shell and the other end of the dye donor web is mounted on the take-up spool in the second shell. Thus the dye donor web is suspended between the supply spool and the take-up spool and covers the opening defined between the arms. As the printer is operated, motors that may be connected to the supply spool and the take-up spool operate the supply spool and the take-up spool so that the dye donor web is supplied from the supply spool and taken-up on the take-up spool. Also, the print head which is aligned with the opening between the arm and which is disposed on one side of the dye donor web activates the dye donor web to transfer dye therefrom to the receiver medium also aligned with the opening but disposed on another side of the dye donor web in order to print an image on the receiver medium.

However, in order to obtain suitable printed images, it is desirable to tension the dye donor web as the dye donor web is supplied from the supply spool and taken-up by the take-up spool. The purpose of tensioning the dye donor web is to avoid an excessive amount of the donor web from unspooling from the supply spool or the take-up spool. Unspooling of the dye donor web from either the supply spool or the take-up spool could cause any one of several problems to arise during printing. For example, such unspooling could cause non-uniformity of dye transfer to the receiver medium. As another example, such unspooling could cause excessive amounts of donor web to enter into the print head and receiver interface region thereby resulting in image artifacts appearing on the receiver medium. As yet another example, such unspooling could cause excessive slack in the donor web, which in turn could lead to mechanical malfunctions in the printer's components.

Devices to tension the dye donor web are known. For example, a drag brake mounted for this purpose is disclosed by U.S. Pat. No. 5,661,515 titled "Printer With Feed Fault Detection" issued Aug. 26, 1997 in the name of Charles M. Hevenor. More specifically, this patent discloses a drag brake mounted in a printer and which connects with a supply spool through a disengagement coupling to maintain tension on the donor web during printing. However, the drag brake disclosed by the Hevenor patent requires use of a slip-clutch coupling permanently mounted in the printer. This is an additional component that increases complexity and cost of the printer.

Therefore, there has been a long-felt need to provide a dye cartridge system and method adapted to tension a dye ribbon associated therewith in a manner such that complexity and cost of the printer are reduced.

SUMMARY OF THE INVENTION

The invention resides in a dye cartridge system comprising a spool having a dye ribbon wound thereabout and an encasement housing said spool. The cartridge has a portion thereof movable from a first position spaced-apart from the dye ribbon to a second position contacting the dye ribbon for imposing a drag force on the dye ribbon.

More specifically, the invention is a dye cartridge system adapted to tension a dye ribbon associated therewith. The cartridge system comprises a first spool disposed in an enclosure belonging to a printer. The first spool has the dye ribbon wound thereabout. The dye ribbon has a leading end portion extending from the first spool. A second spool is associated with the first spool, the second spool having the leading end portion of the dye ribbon connected thereto. In this manner, the dye ribbon has an extended portion thereof suspended between the first spool and the second spool. A cartridge body, which houses the first spool and the second spool, has a flexible portion movable from a first position thereof spaced-apart from the dye ribbon wound about the first spool to a second position thereof into engagement with the dye ribbon wound about the first spool. When the flexible portion moves to the second position thereof, it imposes a drag force acting on the dye ribbon in order to tension the dye ribbon as the drag force acts on the dye ribbon. In addition, a print head is disposed adjacent the extended portion of the dye ribbon to activate the dye ribbon for transferring dye from the dye ribbon to a receiver medium. Moreover, a biasing member engages the flexible portion of the cartridge for biasing the flexible portion, so that the flexible portion moves from the first position thereof to the second position thereof as the flexible portion is biased. The biasing member may be a spring member, a pneumatic cylinder, or any suitable means of biasing the flexible portion into engagement with the dye ribbon wound about the first spool. In addition, the print head may be a thermal resistive print head for thermally activating the dye ribbon. The biasing member can be used to produce drag force on either or both of first spool and second spool. The drag force applied when using biasing members on both spools can accept equal or unequal tension force.

An object of the present invention is to provide a dye cartridge system and method adapted to tension a dye ribbon associated therewith, which cartridge system and method obviates the need to add complex components to the printer in order to tension the dye ribbon.

A feature of the present invention is the provision of a dye cartridge having a flexible portion thereof engageable with the dye ribbon as the dye ribbon is wound about the first spool for imposing a drag force on the dye ribbon.

An advantage of the present invention is that it reduces complexity and cost of the printer.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
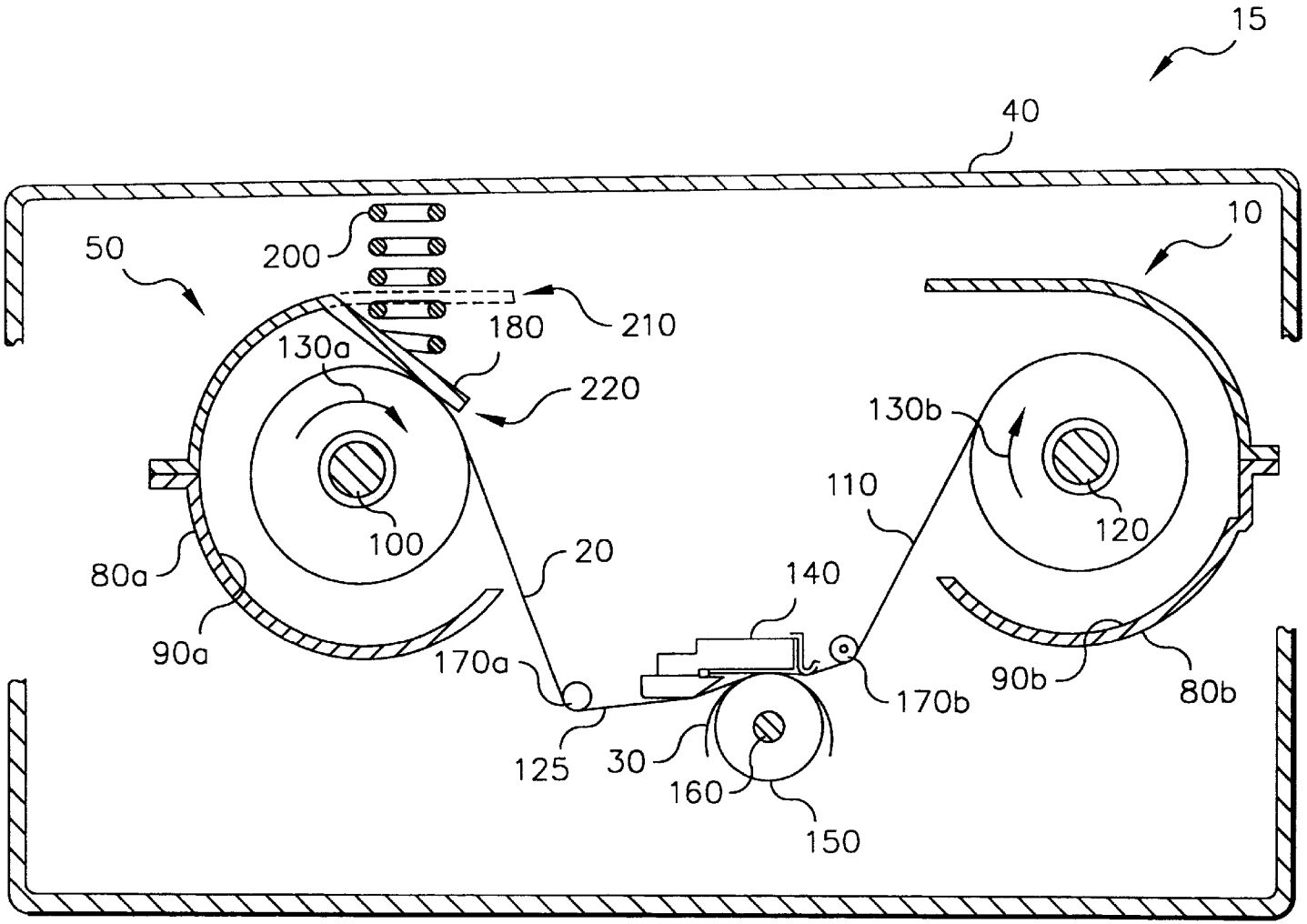
FIG. 1 is a view in vertical section of a first embodiment cartridge usable with a printer apparatus shown with parts removed for clarity.

Therefore, referring to FIG. 1, there is shown the subject matter of the present invention, which is a dye cartridge system, generally referred to as 10, usable with a printer apparatus, generally referred to as 15. Cartridge system 10 is adapted to tension a dye ribbon 20 associated therewith, as disclosed in more detail hereinbelow. Printer 15 may be a thermal resistive printer and dye ribbon 20 may comprise a plurality of color patches (not shown) for obtaining color images to be deposited on a receiver medium 30. Receiver medium 30 may be cut sheets of paper or transparency.

Referring to FIGS. 1 and 2, printer 15 comprises an enclosure 40 enclosing a dye encasement or cartridge body therein, generally referred to as 50. For reasons disclosed hereinbelow, cartridge body 50 is preferably formed from a resilient material, which may be a plastic material, such as polypropylene, polyalkylene, terephthalate, polyimide, polyether imide, polyether ketone, polyether sulfone, polycarbonate, cellulose acetate, or the like. Cartridge body 50 has a pair of parallel elongate spaced-apart side arms 60*a* and 60*b* defining a space or opening 70 therebetween for reasons provided hereinbelow. Integrally connected to respective ends of side arms 60*a* and 60*b* is a generally tubular first shell 80*a* defining a first chamber 90*a* and a generally tubular second shell 80*b* defining a second chamber 90*b*. Centered in first chamber 90*a* and extending longitudinally therealong is a first spool, such as a dye ribbon supply spool 100, having a portion of dye ribbon 20 wound thereabout. In this dye ribbon 20 has a leading end portion extending from supply spool 100. A second spool, such as a take-up spool 120, is centered in second chamber 90*b* and extends longitudinally therealong. Leading end portion 110 is connected to take-up spool 120. In this manner, dye ribbon 20 defines an extended portion 125 thereof suspended between supply spool 100 and take-up spool 120. Supply spool 100 and take-up spool 120 may have suitable motors (not shown) engageable therewith for asynchronously rotating supply spool 100 and take-up spool 120 in the directions shown by arrows 130*a* and 130*b*, respectively. Also disposed in enclosure 40 is a print head 140 located adjacent the extended portion 125. Print head 140 may be a thermal resistive print head having a plurality of thermal resistive elements (not shown) therein for thermally activating dye ribbon 20 in order to transfer dye from dye ribbon 20 to receiver medium 30, which receiver medium 30 is interposed between a support member, such as a platen roller 150, and print head 140. The purpose of platen roller 150 is to provide support to receiver medium 30 as print head presses against receiver medium 30 to deposit an image thereon. Platen roller 150 may be rotatable by means of a rotatable spindle 160 on which platen roller 150 may be mounted. Platen roller 150 may be rotatable for in order to obtain constant velocity of receiver medium 30. Moreover, a pair of rollers 170*a* and 170*b* may be provided on either side of print head 140 and engaging extended portion 125 of dye ribbon 20 for the prevention of wrinkles in the dye ribbon 20.

Still referring to FIGS. 1 and 2, first shell 80*a* belonging to cartridge body 50 preferably includes a flexible portion or flexible flap 180 integrally attached thereto. In the preferred embodiment of the invention, flap 180 is defined by a pair of parallel spaced-apart slits 190*a* and 190*b* cut into first shell 80*a* on either side of flap 180. Cartridge body 50 is formed of the previously mentioned plastic material. This material allows flap 180 to be resilient or flexible, which is important for reasons provided presently.

Referring to FIG. 2A, there is shown an alternative embodiment of the present invention. In this embodiment of the present invention, there is provided a pair of L-shaped slits 195*a*/*b* formed on opposite sides of flap 180, such as to define an intermediate portion 197 therebetween. The advantage of this configuration is that it allows greater flexibility in flap 180. This will allow for a wider range of materials to achieve the desired flexibility. It is appreciated that the width of slits 195*a*/*b* and/or the width of portion 197 can be optimized to achieve the desired flexibility.

Figure 2B:
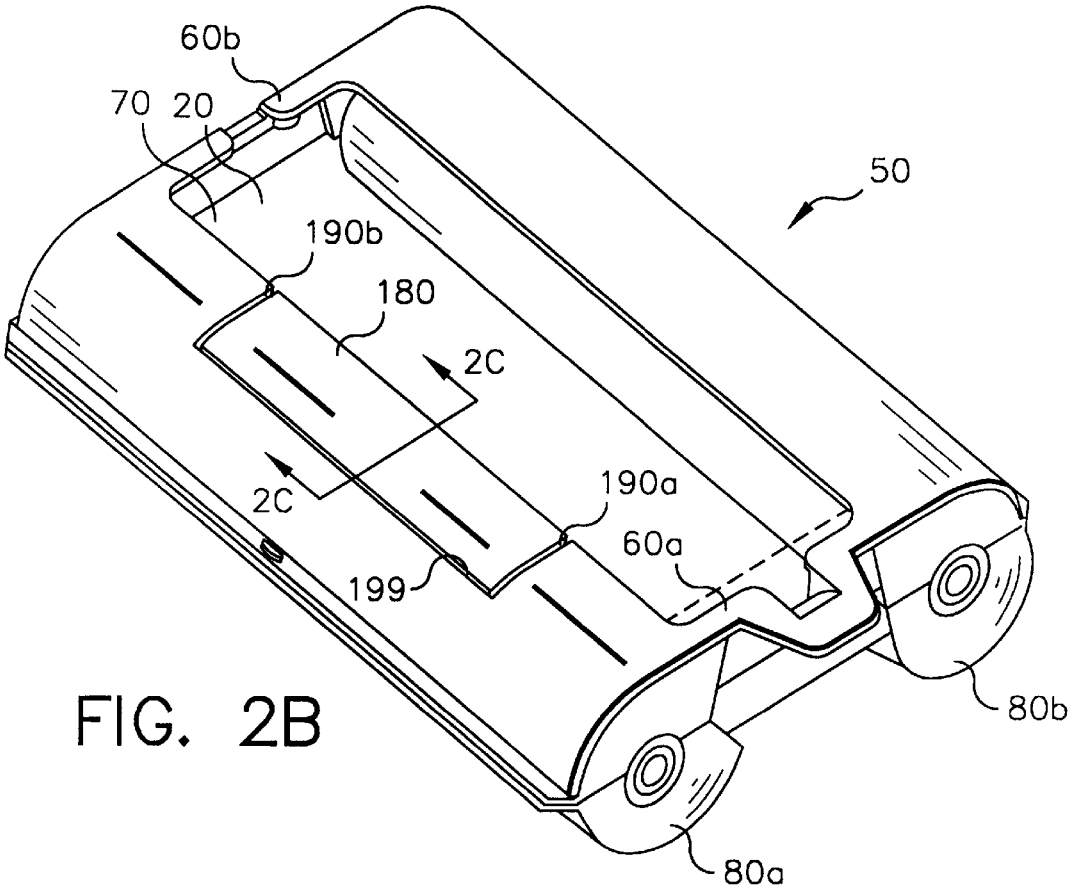
FIG. 2 is a view in perspective of the dye cartridge.
Figure 2C:
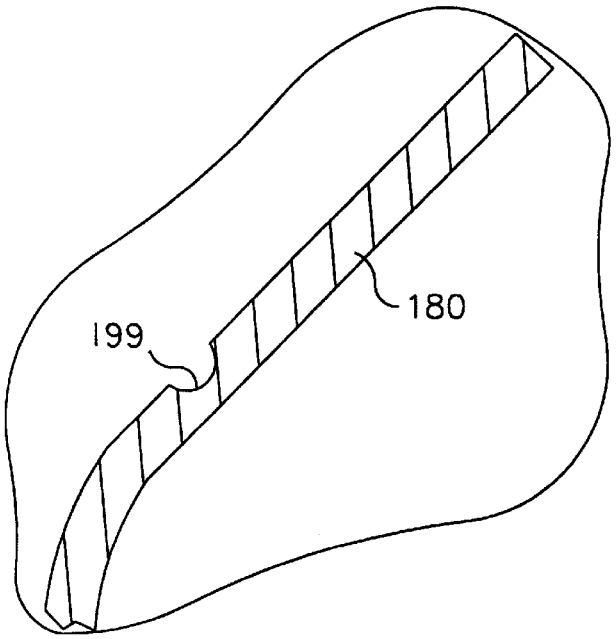
Figure 2B:
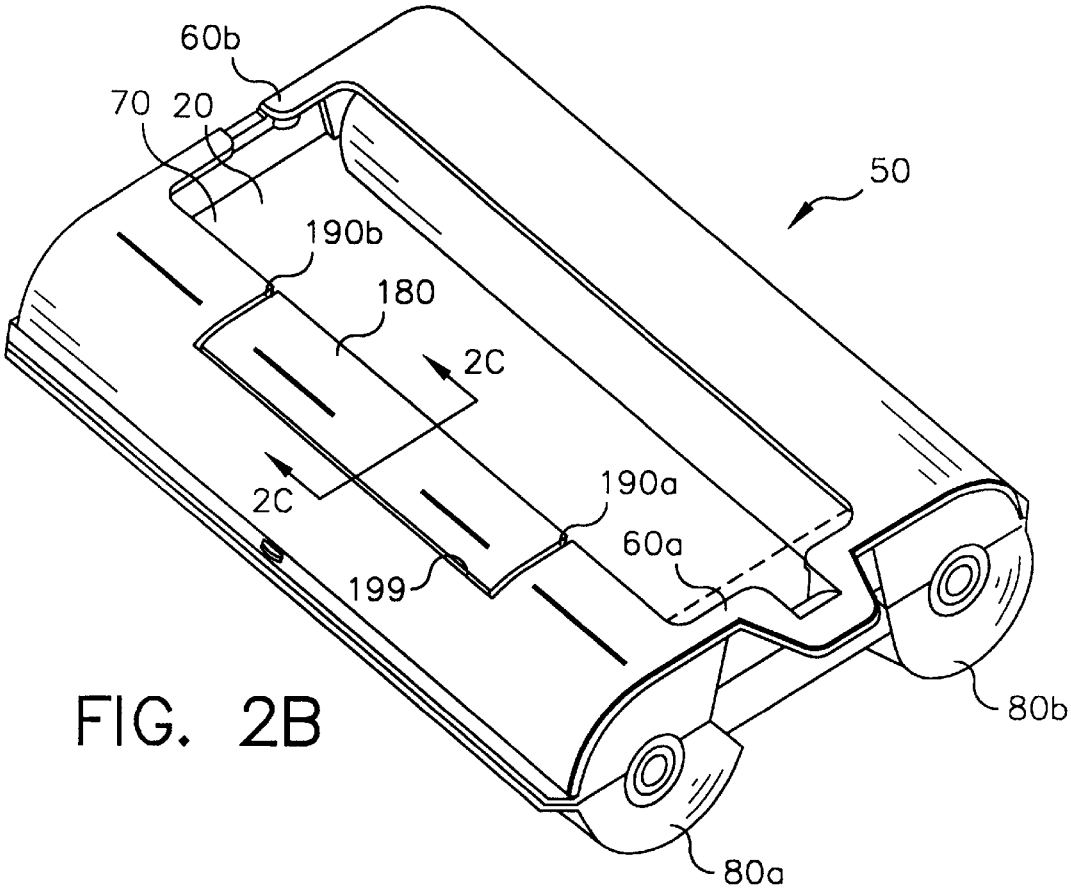
Figure 2C:
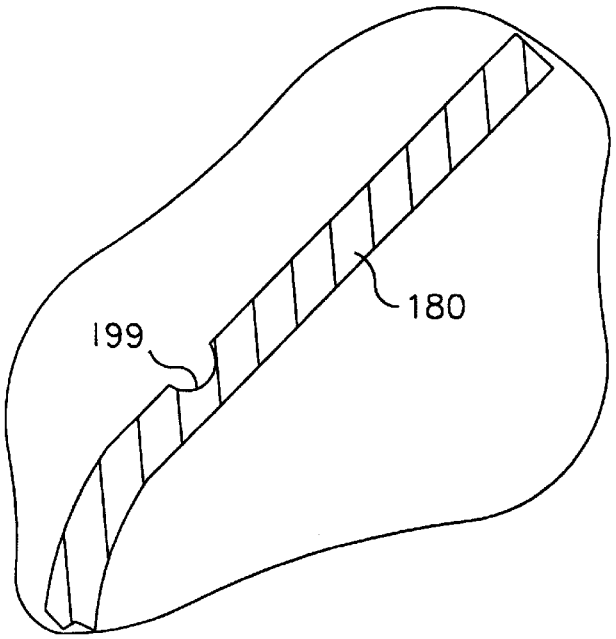

Referring to FIGS. 2B and 2C, there is shown yet another alternative embodiment of the present invention. In this embodiment of the present invention, a relief 199 extends between slits 190*a* and 190*b*. The advantage of this configuration is that it enhances the compliance of flap 180 as compared to relief 199 not being present. It is appreciated from the teachings herein that the intent of relief 199 is to reduce the cross section of flap 180 in order to achieve flexibility of flap 180. Therefore, of course, cross section of flap 180 can be reduced by other means. For example, the cross section of flap 180 can be reduced by forming the relief on the side opposite of that shown. Also, there may be two reliefs, one on each side of flap 180.

Referring yet again to FIGS. 1 and 2, a biasing member 200 is disposed in printer 15 and is capable of engaging flap 180 for moving flap 180 from a first position thereof, generally referred to as 210, spaced-apart from dye ribbon 20 wound about supply spool 100 to a second position thereof, generally referred to as 220, into engagement with dye ribbon 20 wound about supply spool 100. For example, as biasing member 200 engages flap 180, biasing member 200 may exert a biasing force of about 8 to 15 inch-ounce. As flap 180 is biased it will contact or engage dye ribbon 20 wound about supply spool 100 and will impose a drag force on dye ribbon 20 in order to tension dye ribbon 20 as dye ribbon 20 is supplied from supply spool 100 to take-up spool 120. Biasing member 200 is selected such that it creates a substantially constant biasing force on dye ribbon 20 as the diameter of dye ribbon 20 on supply spool 100 decrease as dye ribbon 20 is supplied from supply spool 100. In this regard, the tensioning force acting on dye ribbon 20 decreases as dye ribbon 20 is supplied from about supply spool 100. In the preferred embodiment of the invention, biasing member 200 is interposed between enclosure 40 and flap 180 and may be a coiled spring member. Of course, the biasing member can be used to produce drag force on either or both of supply spool 100 and take-up spool 120. The drag force applied when using biasing members on both spools 100/120 can accept equal or unequal tension force.

Figure 3:
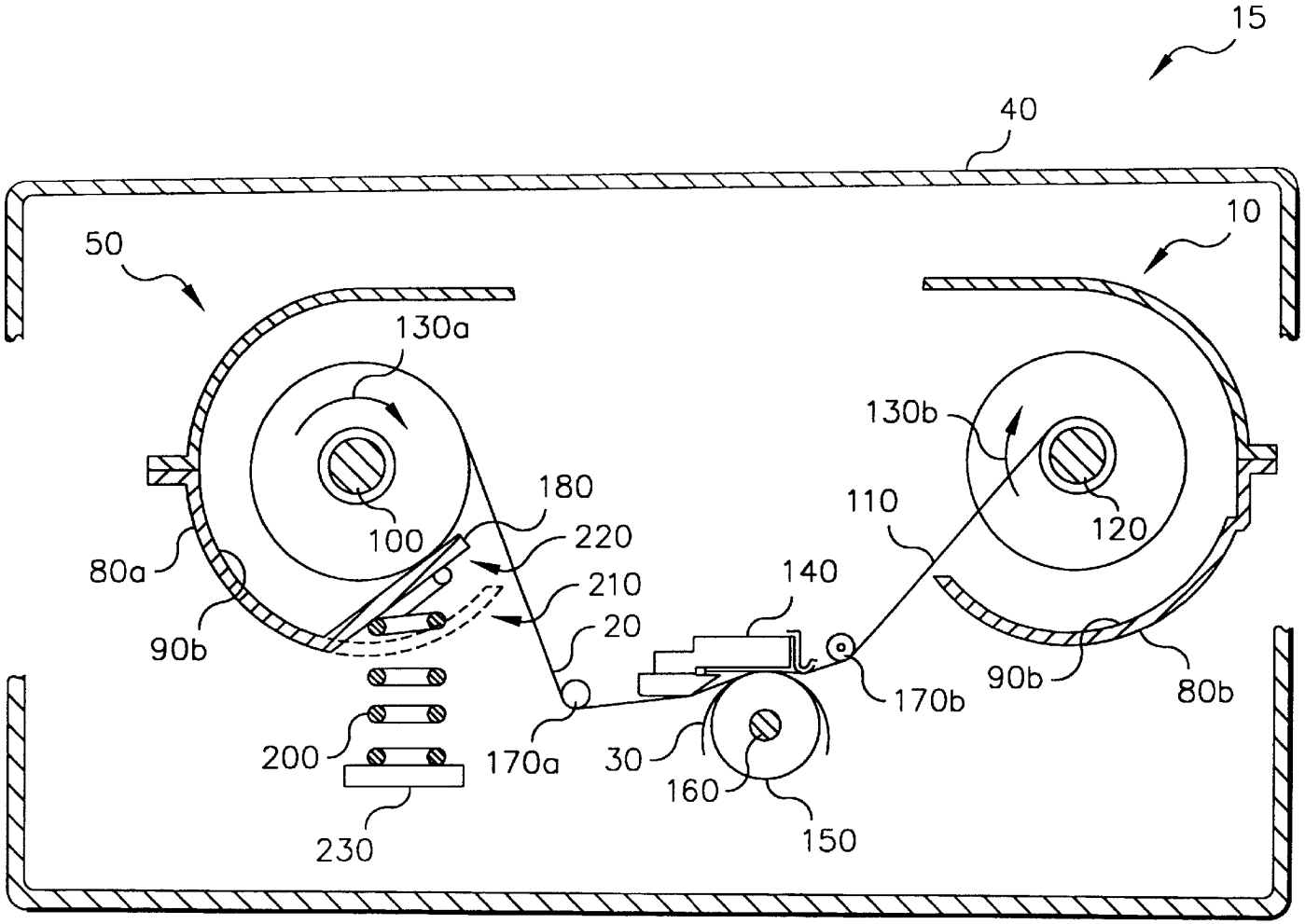
FIG. 3 is a view in vertical section of a second embodiment dye cartridge system usable with the printer apparatus.

Turning now to FIG. 3, there is shown a second embodiment cartridge system 10 usable with printer 15, wherein flap 180 is formed in an underside portion of first shell 80a and biasing member 200 is interposed between flap 180 and a pedestal 230 disposed in enclosure 40.

Figure 4:
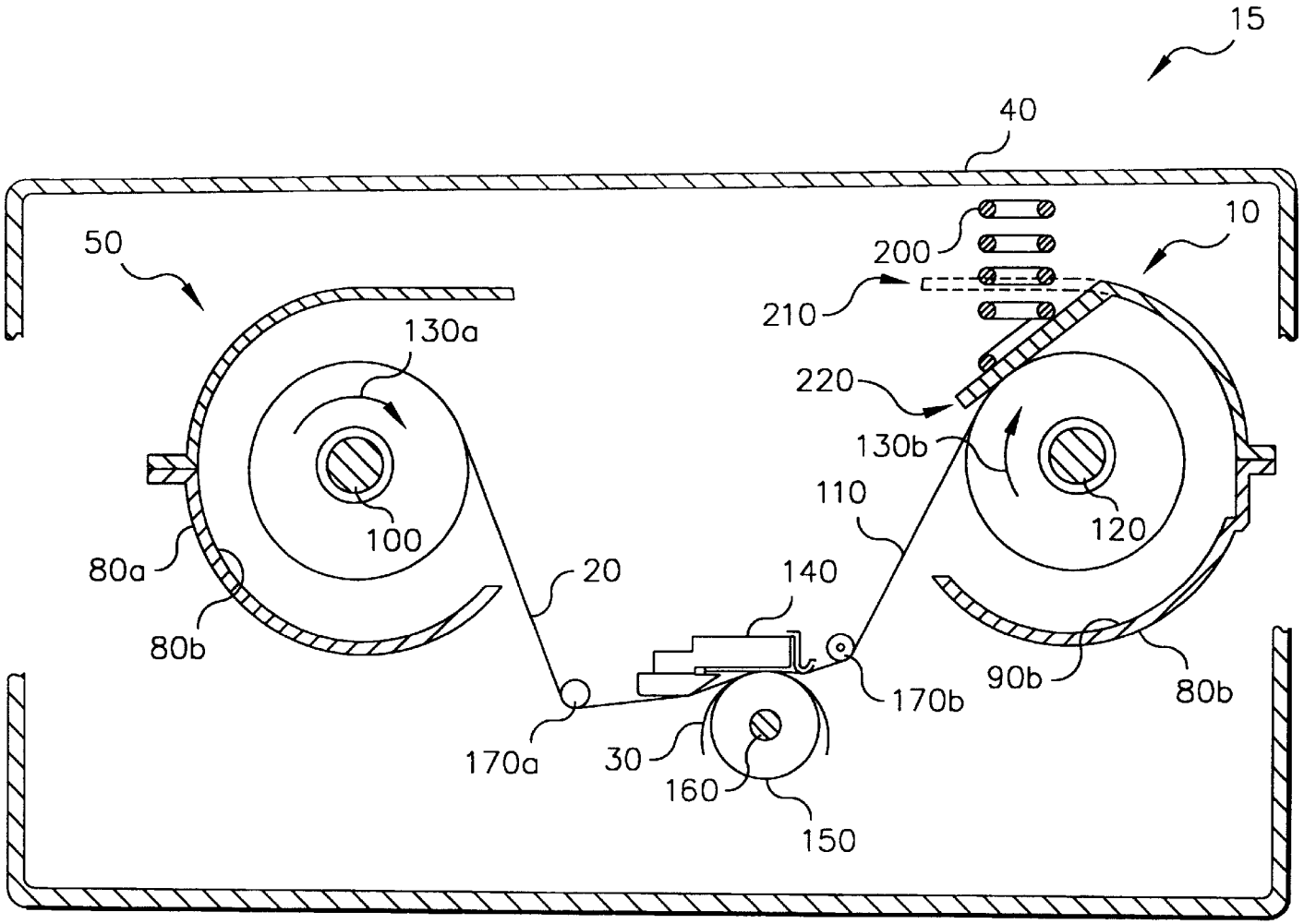
FIG. 4 is a view in vertical section of a third embodiment dye cartridge system usable with the printer apparatus.

Referring to FIG. 4, there is shown a third embodiment cartridge system 10 usable with printer 15, wherein flap 180 is formed in second shell 80*b* and biasing member 200 is interposed between flap 180 and enclosure 40 for tensioning dye ribbon 20 as dye ribbon 20 winds about take-up spool 120.

Figure 5:
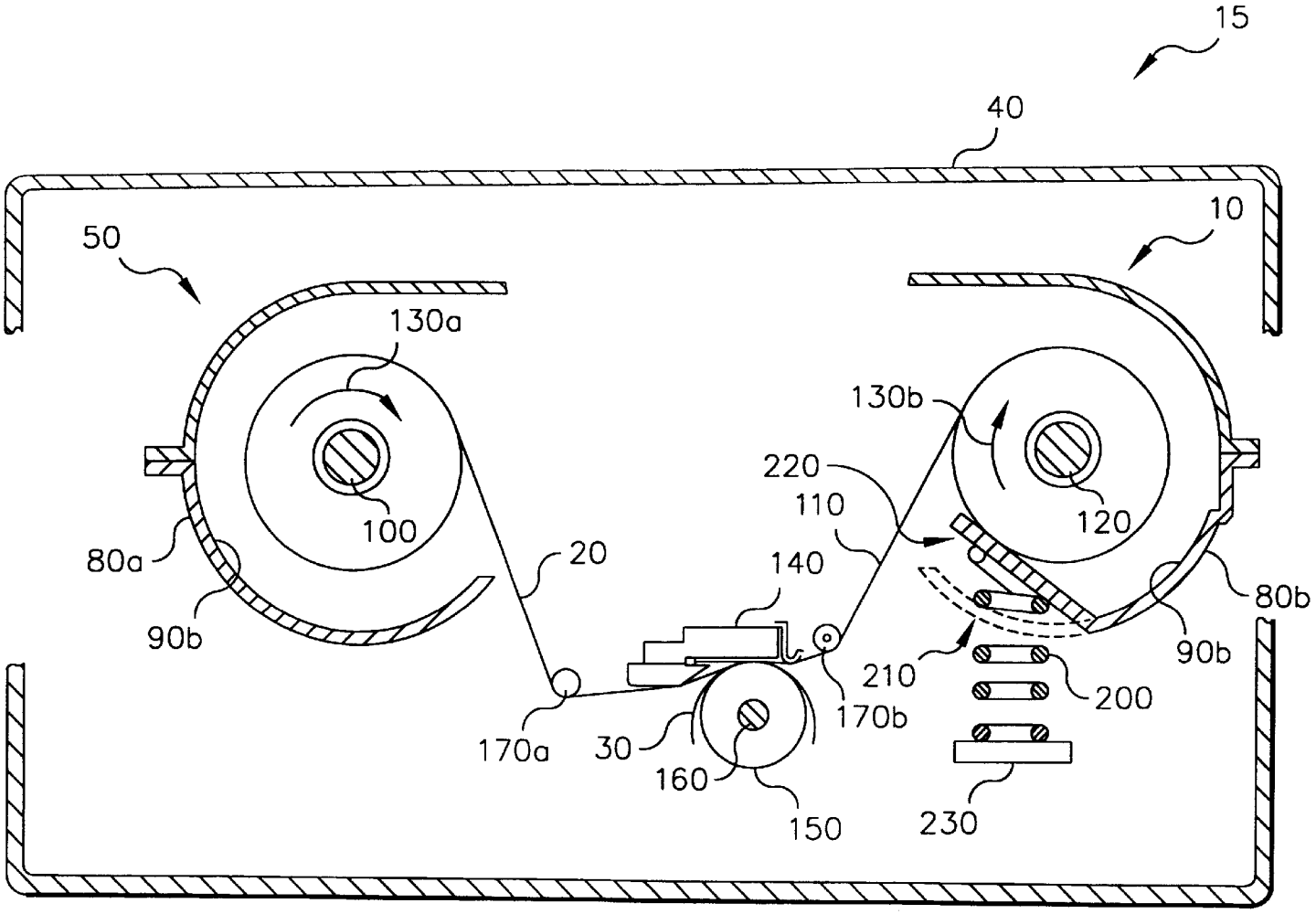
FIG. 5 is a view in vertical section of a fourth embodiment dye cartridge system usable with the printer apparatus.

Referring to FIG. 5, there is shown a fourth embodiment cartridge system usable with printer 15, wherein flap 180 is formed in an underside portion of second shell 80*b* and biasing member 200 is interposed between flap 180 and pedestal 230 disposed in enclosure 40.

Figure 6:
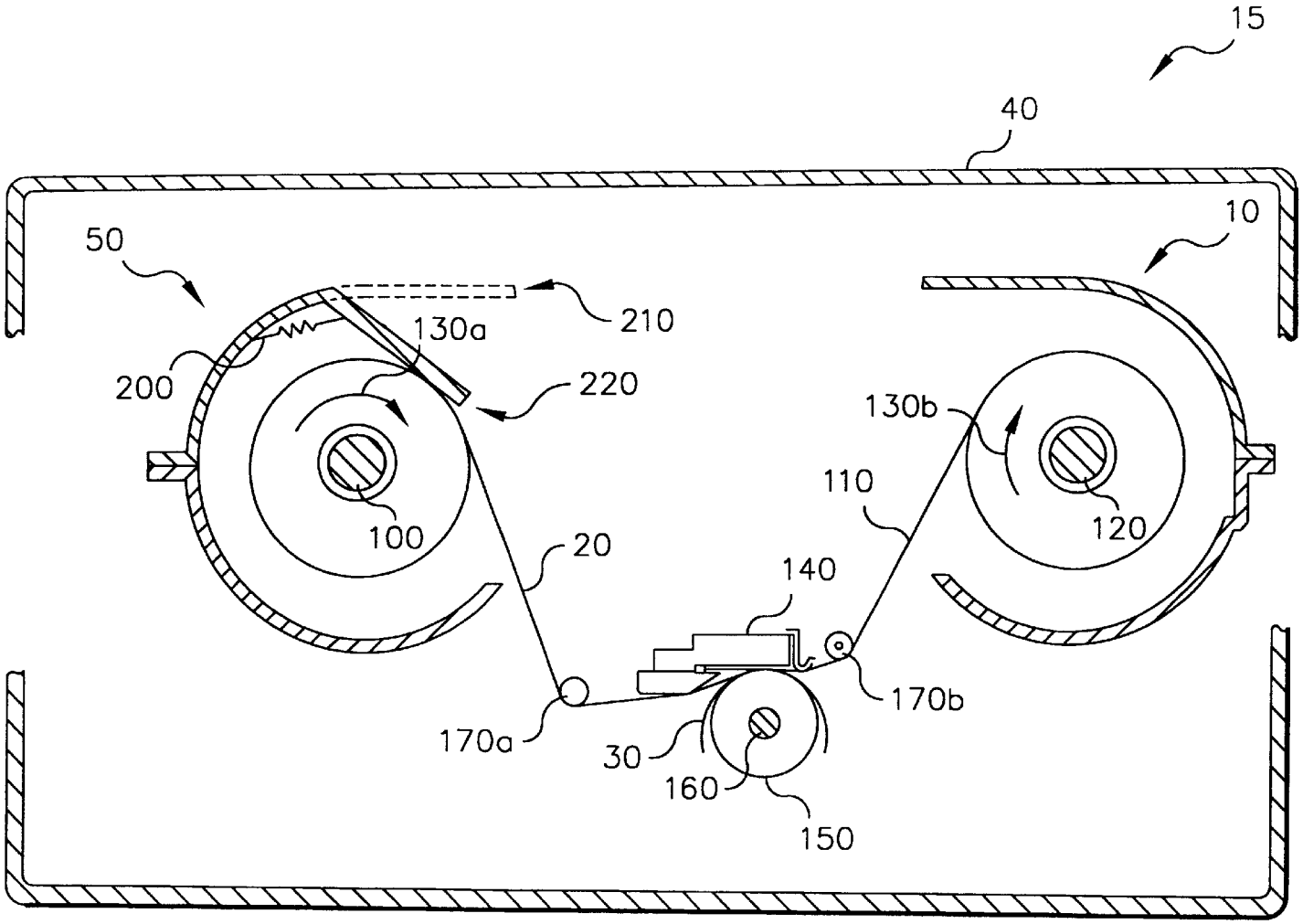
FIG. 6 is a view in vertical section of a fifth embodiment dye cartridge system usable with the printer apparatus.

Referring to FIG. 6, there is shown a fifth embodiment cartridge system 10 usable with printer 15, wherein biasing member 200, which may a resilient spring, is disposed in first chamber 90*a* and interconnects flap 180 to an inner wall of first shell for biasing flap 180 into contact with dye ribbon 20 wound about first spool 100.

Figure 7:
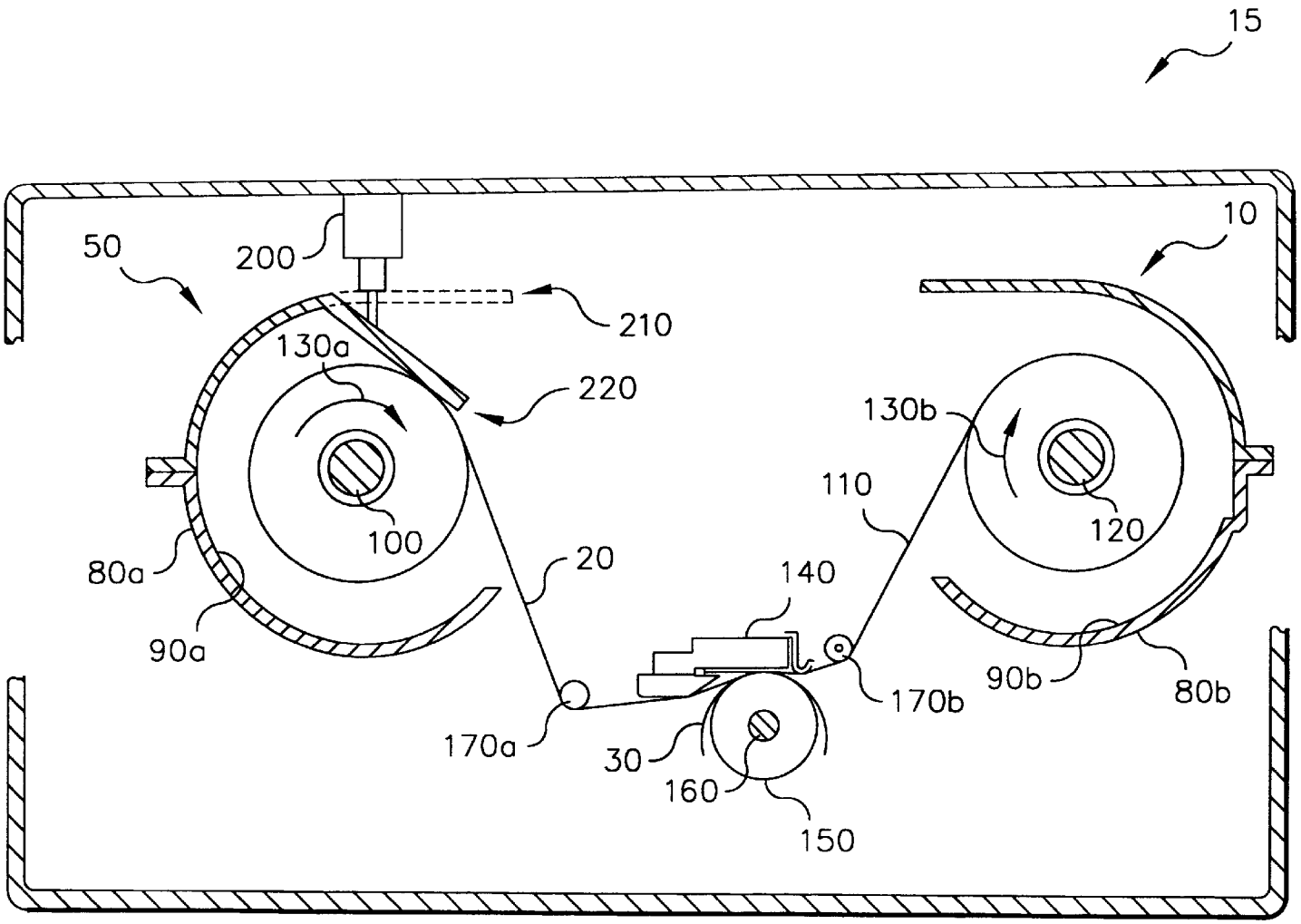
FIG. 7 is a view in vertical section of a sixth embodiment dye cartridge system usable with the printer apparatus.

Referring to FIG. 7, there is shown a sixth embodiment cartridge system 10 usable with printer 15, wherein biasing member 200 is a pneumatic cylinder interposed between enclosure 40 and flap 180.

It is appreciated from the teachings herein that an advantage of the present invention is that it reduces complexity and cost of the printer. This is so because the dye cartridge body belonging to the cartridge system comprises an integrally attached flap for creating drag force on the dye ribbon, therefore making it unnecessary to include the additional component of a slip-clutch coupling permanently mounted in the printer.

While the invention has been described with particular reference to its preferred embodiments, it will be understood by those skilled in the art that various changes may be made and equivalents may be substituted for elements of the preferred embodiments without departing from the invention. In addition, many modifications may be made to adapt a particular situation and material to a teaching of the present invention without departing from the essential teachings of the invention. For example, biasing member 200 may be attached to a door (not shown) belonging to a front side of printer 15, which door allows loading of cartridge body 50 into printer 15. In this regard, biasing member 200 will engage flap 180 only when the door is closed and will disengage flap 180 when the door is opened for convenience of loading cartridge body 50 into printer 15.

As is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is to a cartridge system and method adapted to tension a dye ribbon associated therewith.

PARTS LIST

10 . . . cartridge system
15 . . . printer
20 . . . dye ribbon
30 . . . receiver medium
40 . . . enclosure
50 . . . dye cartridge body
60*a/b*. . . side arms
70 . . . opening
80*a/ib*. . . first and second shells
90*a/fb*. . . first and second chambers
100 . . . supply spool
110 . . . leading end portion
120 . . . take-up spool
125 . . . extended portion
130*a/b*. . . arrows
140 . . . print head
150 . . . platen roller
160 . . . spindle
170*a/b*. . . rollers
180 . . . flap
190*a/b*. . . slits
195*a/b*. . . L-shaped slit
197 . . . intermediate portion
199 . . . relief
200 . . . spring member
210 . . . first position
220 . . . second position
230 . . . pedestal

What is claimed is:

1. A cartridge system, comprising:

(a) a spool having a dye ribbon wound thereabout;

(b) an encasement housing said spool, said encasement having a portion thereof movable from a first position spaced-apart from the dye ribbon to a second position contacting the dye ribbon for imposing a drag force on the dye ribbon; and (c) a biasing member engaging the movable portion of said encasement for biasing the movable portion from the first position thereof to the second position thereof.

2. A cartridge system adapted to tension a dye ribbon associated therewith, comprising:

(a) a spool having the dye ribbon wound thereabout;

(b) a cartridge body housing said spool, said cartridge body having a flexible portion movable from a first position thereof spaced-apart from the dye ribbon to a second position thereof into engagement with the dye ribbon for imposing a drag force on the dye ribbon, whereby the dye ribbon is tensioned as the drag force is imposed on the dye ribbon;

(c) a print head disposed adjacent the dye ribbon for transferring dye from the dye ribbon; and (d) a biasing member engaging the flexible portion of said cartridge body for biasing the flexible portion, so that the flexible portion moves from the first position thereof to the second position thereof.

3. A cartridge system adapted to tension a dye ribbon associated therewith, comprising:

(a) an enclosure;

(b) a first spool disposed in said enclosure, said first spool having the dye ribbon wound thereabout, the dye ribbon having a leading end portion extending from the first spool;

(c) a second spool in association with said first spool, said second spool having the leading end portion of the dye ribbon connected thereto, so that the dye ribbon has an extended portion thereof suspended between said first spool and said second spool;

(d) a cartridge body housing said first spool and said second spool, said cartridge body having a flexible portion movable from a first position thereof spaced-apart from the dye ribbon wound about said first spool to a second position thereof into engagement with the dye ribbon wound about said first spool for imposing a drag force acting on the dye ribbon, whereby the dye ribbon is tensioned as the drag force acts on the dye ribbon;

(e) a print head disposed adjacent the extended portion of the dye ribbon to activate said dye ribbon for transferring dye from the dye ribbon; and (f) a biasing member engaging the flexible portion of said cartridge body for biasing the flexible portion, so that the flexible portion moves from the first position thereof to the second position thereof as the flexible portion is biased.

4. The cartridge system of claim 3, wherein said biasing member is a spring member.

5. The cartridge system of claim 3, wherein said biasing member is a pneumatic cylinder.

6. The cartridge system of claim 3, wherein said print head is a thermal resistive print head for thermally activating the dye ribbon.

7. A method of tensioning a dye ribbon, comprising the steps of:

(a) providing a spool having the dye ribbon wound thereabout;

(b) housing the spool in an encasement, the encasement having a portion thereof movable from a first position spaced-apart from the dye ribbon to a second position contacting the dye ribbon for imposing a drag force on the dye ribbon; and (c) engaging a biasing member with the movable portion of the cartridge body for biasing the movable portion from the first position thereof to the second position thereof.

8. A method adapted to tension a dye ribbon associated therewith, comprising the steps of:

(a) providing a spool having the dye ribbon wound thereabout;

(b) housing the spool in a cartridge body, the cartridge body having a flexible portion movable from a first position thereof spaced-apart from the dye ribbon to a second position thereof into engagement with the dye ribbon for imposing a drag force on the dye ribbon, whereby the dye ribbon is tensioned as the drag force is imposed on the dye ribbon;

(c) disposing a print head adjacent the dye ribbon for transferring dye from the dye ribbon; and (d) engaging a biasing member with the flexible portion of the cartridge body for biasing the flexible portion, so that the flexible portion moves from the first position thereof to the second position thereof.

9. A method adapted to tension a dye ribbon associated therewith, comprising:

(a) providing an enclosure;

(b) disposing a first spool in the enclosure, the first spool having the dye ribbon wound thereabout, the dye ribbon having a leading end portion extending from the first spool;

(c) associating a second spool with the first spool, the second spool having the leading end portion of the dye ribbon connected thereto, so that the dye ribbon has an extended portion thereof suspended between the first spool and the second spool;

(d) housing the first spool and the second spool in a cartridge body, the cartridge body having a flexible portion movable from a first position thereof spaced-apart from the dye ribbon wound about the first spool to a second position thereof into engagement with the dye ribbon wound about the first spool for imposing a drag force acting on the dye ribbon, whereby the dye ribbon is tensioned as the drag force acts on the dye ribbon;

(e) disposing a print head adjacent the extended portion of the dye ribbon to activate the dye ribbon for transferring dye from the dye ribbon; and (f) engaging a biasing member with the flexible portion of the cartridge body for biasing the flexible portion, so that the flexible portion moves from the first position thereof to the second position thereof as the flexible portion is biased.

10. The method of claim 9, wherein the step of engaging a biasing member with the flexible portion of the cartridge body comprises the step of engaging a spring member with the flexible portion.

11. The method of claim 9, wherein the step of engaging a biasing member with the flexible portion of the cartridge body comprises the step of engaging a pneumatic cylinder with the flexible portion.

12. The method of claim 9, wherein the step of disposing a print head adjacent the extended portion of the dye ribbon comprises the step of disposing a thermal resistive print head adjacent the extended portion of the dye ribbon for thermally activating the dye ribbon.

* * * * *